US007283098B2

(12) United States Patent
Lim

(10) Patent No.: US 7,283,098 B2
(45) Date of Patent: Oct. 16, 2007

(54) ANTENNA APPARATUS FOR PORTABLE TERMINAL

(75) Inventor: Byung-Man Lim, Seoul (KR)

(73) Assignee: Samsung Electronics Co., Ltd. (KR)

( * ) Notice: Subject to any disclaimer, the term of this patent is extended or adjusted under 35 U.S.C. 154(b) by 132 days.

(21) Appl. No.: 11/186,661

(22) Filed: Jul. 21, 2005

(65) Prior Publication Data

US 2006/0145932 A1 Jul. 6, 2006

(30) Foreign Application Priority Data

Dec. 17, 2004 (KR) ..... 10-2004-0107871

(51) Int. Cl.
*H01Q 1/24* (2006.01)

(52) U.S. Cl. ..... 343/702; 343/846

(58) Field of Classification Search ..... 343/702, 343/700 MS, 846

See application file for complete search history.

(56) References Cited

U.S. PATENT DOCUMENTS 6,542,125 B1 4/2003 Hoffmeister et al.
7,012,571 B1 * 3/2006 Ozkar et al. ..... 343/702
2002/0000941 A1 1/2002 Johnson

FOREIGN PATENT DOCUMENTS

| | | |
|---|---|---|
| EP | 1 111 712 | 6/2001 |
| WO | WO98/56066 | 12/1998 |

* cited by examiner

*Primary Examiner*—Hoang V. Nguyen
(74) *Attorney, Agent, or Firm*—The Farrell Law Firm, P.C.

(57) ABSTRACT

Disclosed is an antenna apparatus for a portable terminal which has a variable movement antenna apparatus variably moving a position of a ground surface of an antenna. A sliding type portable terminal includes a body housing, a sliding housing slidably moved to and from the body housing; built-in antenna provided in the body housing; and a variable movement antenna apparatus variably moving a position of a ground surface by separating the ground surface of the antenna and by slidably moving the separated ground surface in the lengthwise direction of the body housing so as to be closer to and farther away from the body housing.

6 Claims, 7 Drawing Sheets

ANTENNA APPARATUS FOR PORTABLE TERMINAL

PRIORITY

This application claims priority to an application entitled "ANTENNA APPARATUS FOR PORTABLE TERMINAL" filed in the Korean Industrial Property Office on Dec. 17, 2004 and assigned Serial No. 2004-107871, the contents of which are hereby incorporated by reference.

BACKGROUND OF THE INVENTION

1. Field of the Invention

The present invention relates to an antenna apparatus for a portable terminal, and more particularly to an antenna apparatus for a portable terminal which has a variable movement antenna apparatus variably moving a position of a ground surface of the antenna.

2. Description of the Related Art

Generally, portable communication devices mean devices by which radio communication can be performed, while the devices are being carried. The portable communication devices include a hand-held phone (HHP), cordless telephone (CT-)2 cellular phone, a digital phone, a personal communications systems (PCS) phone, and a personal digital assistant (PDA) and are sorted into various types according to their shapes. For example, the radio terminals are sorted into a bar type, a flip type, a folder type, and a sliding type according to their shapes. The above-mentioned portable terminals always include an antenna apparatus, a data input and output device, and a data transceiver.

The data output device generally uses a liquid crystal display (LCD).

Basically, a plurality of keys are arranged on a key pad used for data input. The keys include a send (SND) key which is a communication start button, a cancel key, a clear key (CLR), number keys, letter keys, an end (END) key, function keys, a power (PWR) key, etc.

Recently, the number of subscribers of the portable terminals has explosively increased, and the portable terminals have become so demanded that almost all people carry portable terminals. Although at the beginning the portable terminals simply provided voice services, portable terminals providing a radio listening function, an MP3 function, a moving image display function, a remote control function, etc., are available now.

Portable terminals providing a camera, a high speed data communication, and a voice communication function have recently been developed. As these new devices demanded by consumers are mounted within the portable terminals, the space for built-in antennas becomes smaller as the mounting areas for the other devices become larger.

To accommodate the expanding volume required by these other devices, the antenna apparatus for receiving signals transmitted from callers and transmitting signals must be properly positioned in the portable terminals.

The antenna apparatus mainly includes a whip antenna and a helical antenna.

The helical antenna is generally used to lower the mounting height of the antenna. Different from a rod antenna in which a rod is drawn to extend the length of the antenna, the helical antenna has a protruding portion on one side and at the upper portion of the body of the terminal and is detachably fixed to the terminal. However, the terminal having the helical antenna does not have an attractive appearance due to the protruding portion of the antenna.

Recently, built-in antennas have become widely used in the terminals to overcome the above-mentioned disadvantages. A chip antenna, a planar inverted F antenna (PIFA), and a loop antenna are mainly used as built-in antennas.

As shown in FIGS. 1 to 4, the sliding type radio terminal 1 includes a body housing 2 having a main printed circuit board 2*a*, a sliding housing 3 slidably moved from the body housing 2, and a planar inverted F antenna 4 mounted to the body housing 2. The planar inverted F antenna 4 includes a radiation body 4*a* including an electric body formed on a main printed circuit board 2*a* in which a ground surface (not shown) is provided for an impedance value and shorting pins 4*b*.

As shown in FIGS. 2 and 4, in the planar inverted F antenna, the radiation body 4*a* is installed so as to be separated from the ground surface by a predetermined height.

As shown in FIG. 2, the reason why the radiation body 4*a* is installed so as to be separated by a distance L1 (shown in FIG. 2) is because the distance L1 is an element influencing the radiation characteristics and gains of the antenna.

However, for the conventional sliding type portable terminal with the planar inverted F antenna installed, since the space required for mounting a plurality of parts for slidably moving the sliding housing from the body housing becomes greater, less space is available to provide separation between the ground surface and the radiation body due to the limited space in the terminal. Thus the efficiency of the antenna becomes lower and the miniaturization of the terminal is restricted.

Further, with the arrangement of the conventional sliding type portable terminal, if the sliding housing is slidably moved on the body housing, the front surface of the built-in antenna mounted into the body housing is screened, lowering the radiation efficiency of the antenna.

SUMMARY OF THE INVENTION

Accordingly, the present invention has been made to solve the above-mentioned problems occurring in the prior art, and an object of the present invention is to provide an antenna apparatus of a portable terminal, which can improve the performance of an antenna by constituting a variable movement antenna apparatus variably moving a position of a ground surface of the antenna.

It is another object of the present invention is to provide an antenna apparatus of a portable terminal, which can increase the gain and the efficiency thereof by constituting a variable movement antenna apparatus, separating and moving a ground surface thereof and thereby by increasing the separated distance between a radiation body and the ground surface of the built-in antenna of the terminal.

It is still another object of the present invention to provide an antenna apparatus of a portable terminal, which can miniaturize the size of the terminal by separating a ground surface of the antenna and constituting a variable movement antennal apparatus moving the separated ground surface in the sliding housing, thereby separating the ground surface of the built-in antenna of the terminal and separately mounting the ground surface.

In order to accomplish the above objects of the present invention, a sliding type portable terminal includes a body housing, a sliding housing slidably moved to and from the body housing, and a built-in antenna provided in the body housing. The sliding type portable terminal further includes a variable movement antenna apparatus variably moving a position of a ground surface by separating the ground surface of the antenna and by slidably moving the separated ground surface in the lengthwise direction of the body housing so as to be closer to and farther away from the body housing.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENT

Hereinafter, a preferred embodiment of the present invention will be described with reference to the accompanying drawings.

Figure 1:
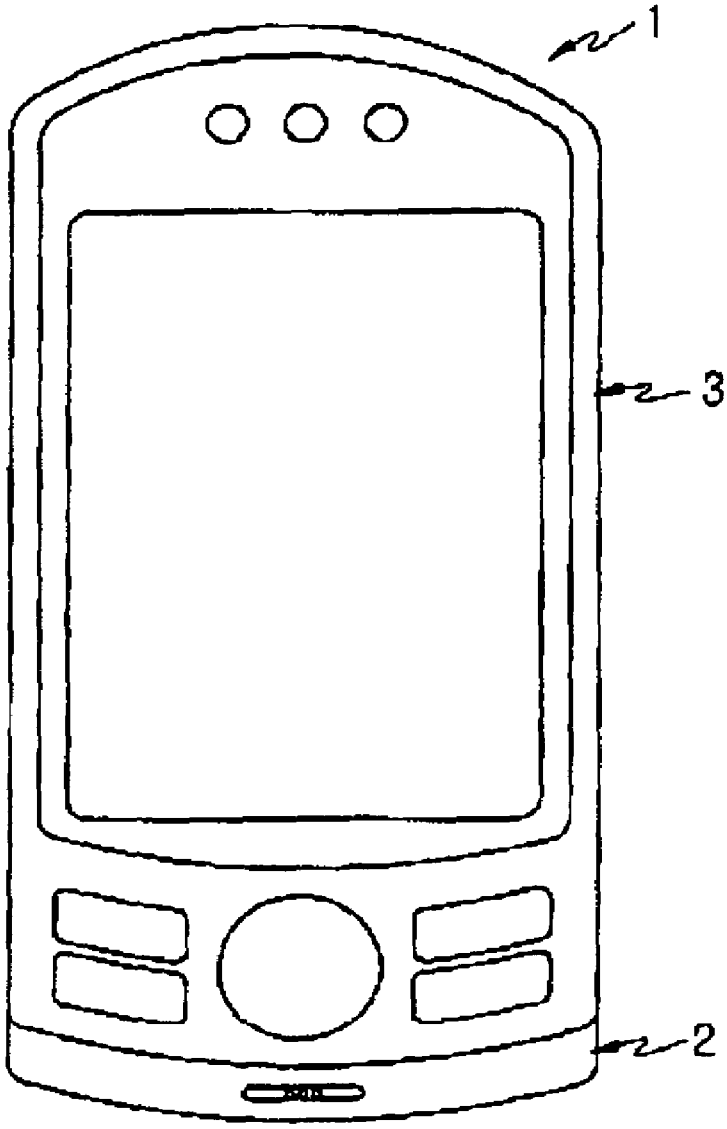
FIG. 1 (PRIOR ART)
FIG. 1 is a front view for showing a sliding type portable terminal including a conventional built-in antenna.
Figure 2:
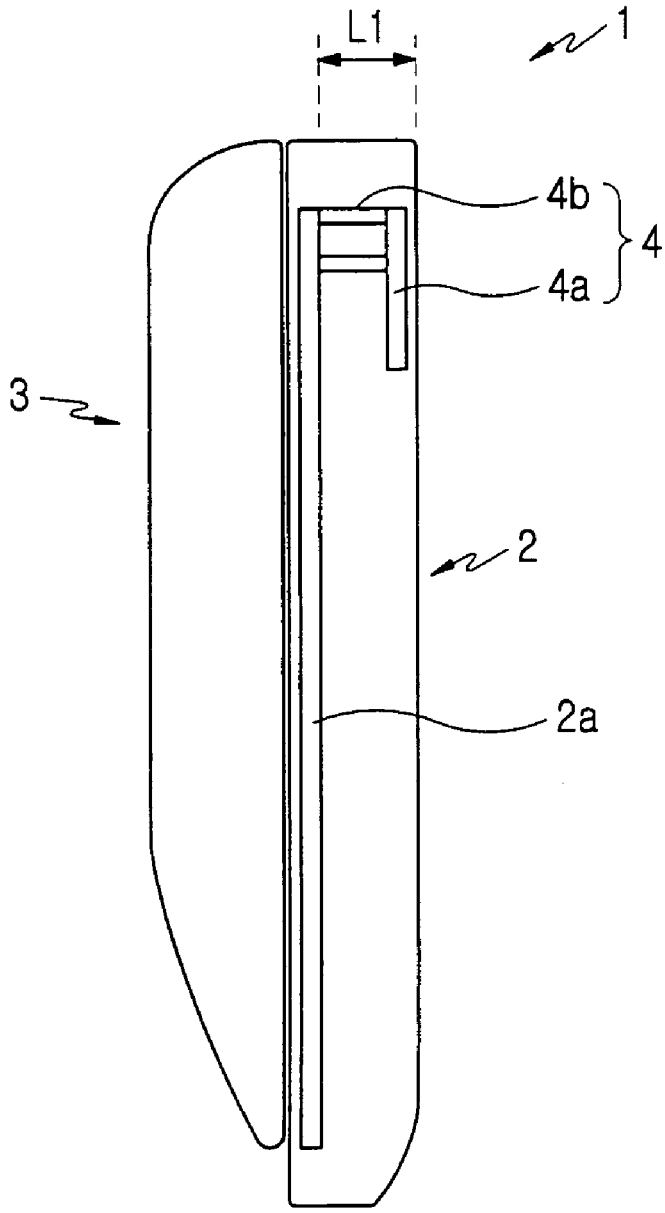
FIG.2 (PRIOR ART)
FIG. 2 is a side cross-sectional view for showing the interior of FIG. 1.
Figure 3:
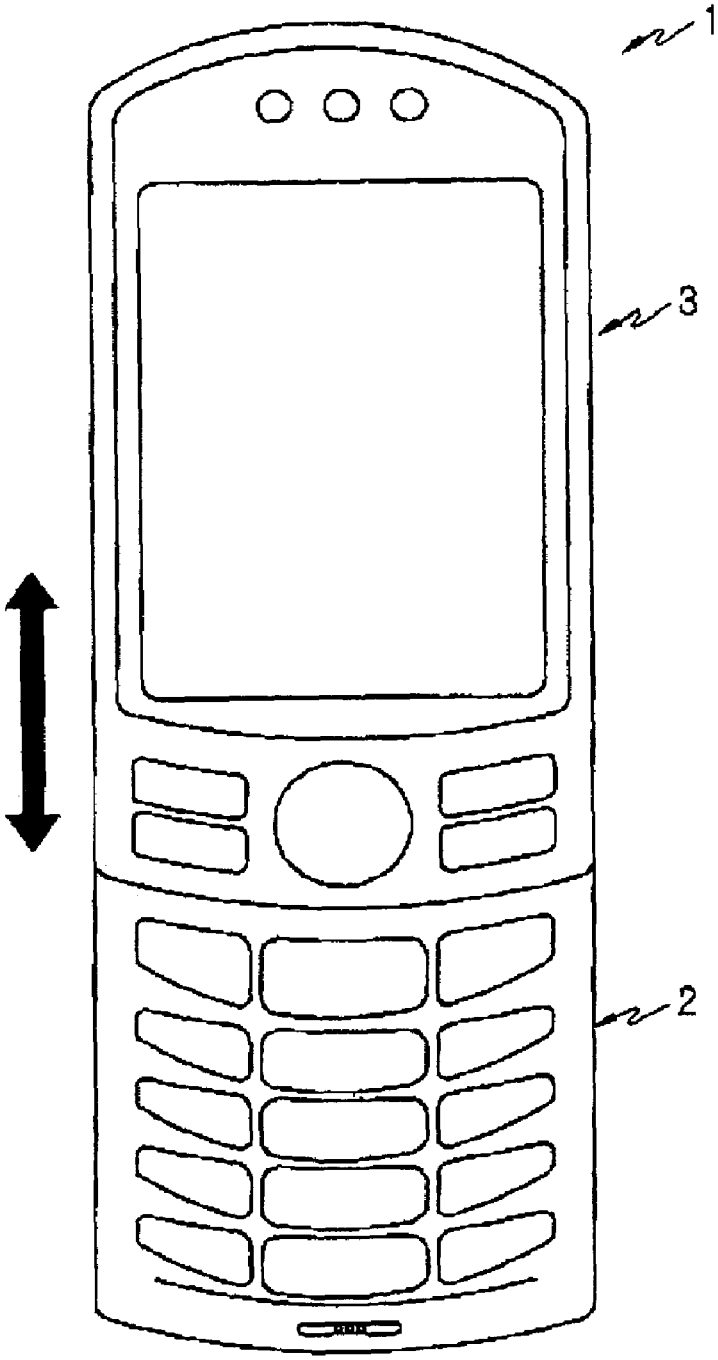
FIG.3 (PRIOR ART)
FIG. 3 is a front view for showing a state in which a sliding housing of a sliding type portable terminal including a conventional built-in antenna is slidably moved.
Figure 4:
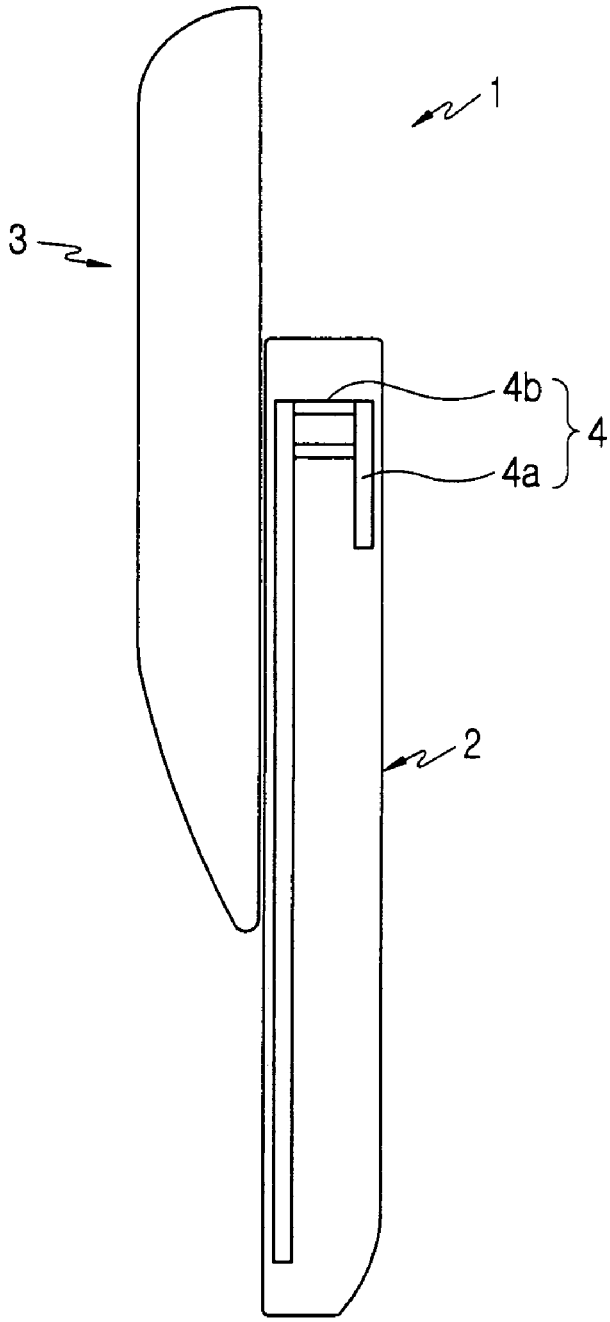
FIG.4 (PRIOR ART)
FIG. 4 is a side cross-sectional view for showing the interior of FIG. 3.
Figure 5:
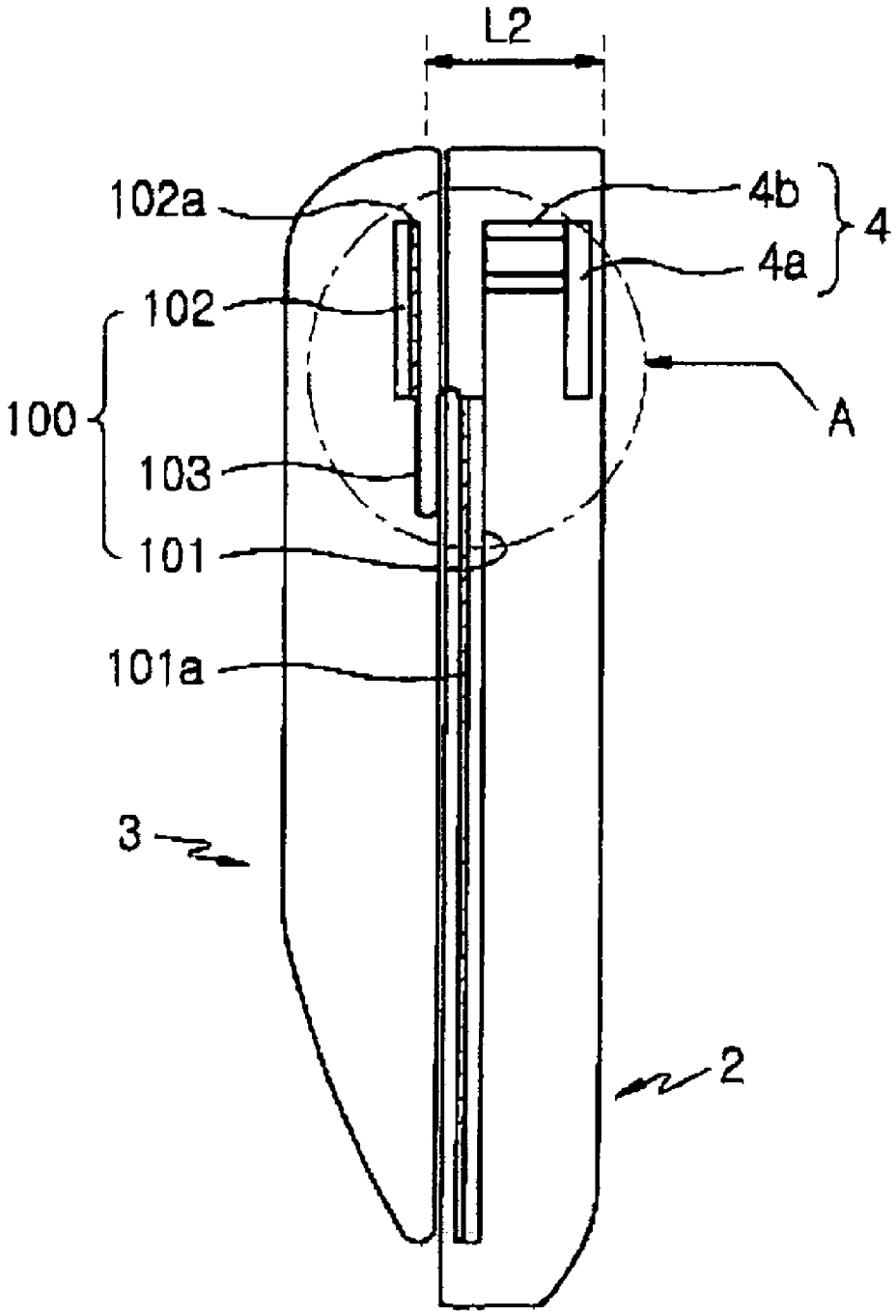
FIG. 5 is a side cross-sectional view showing a structure of an antenna apparatus of a portable terminal according to a preferred embodiment of the present invention.
Figure 6:
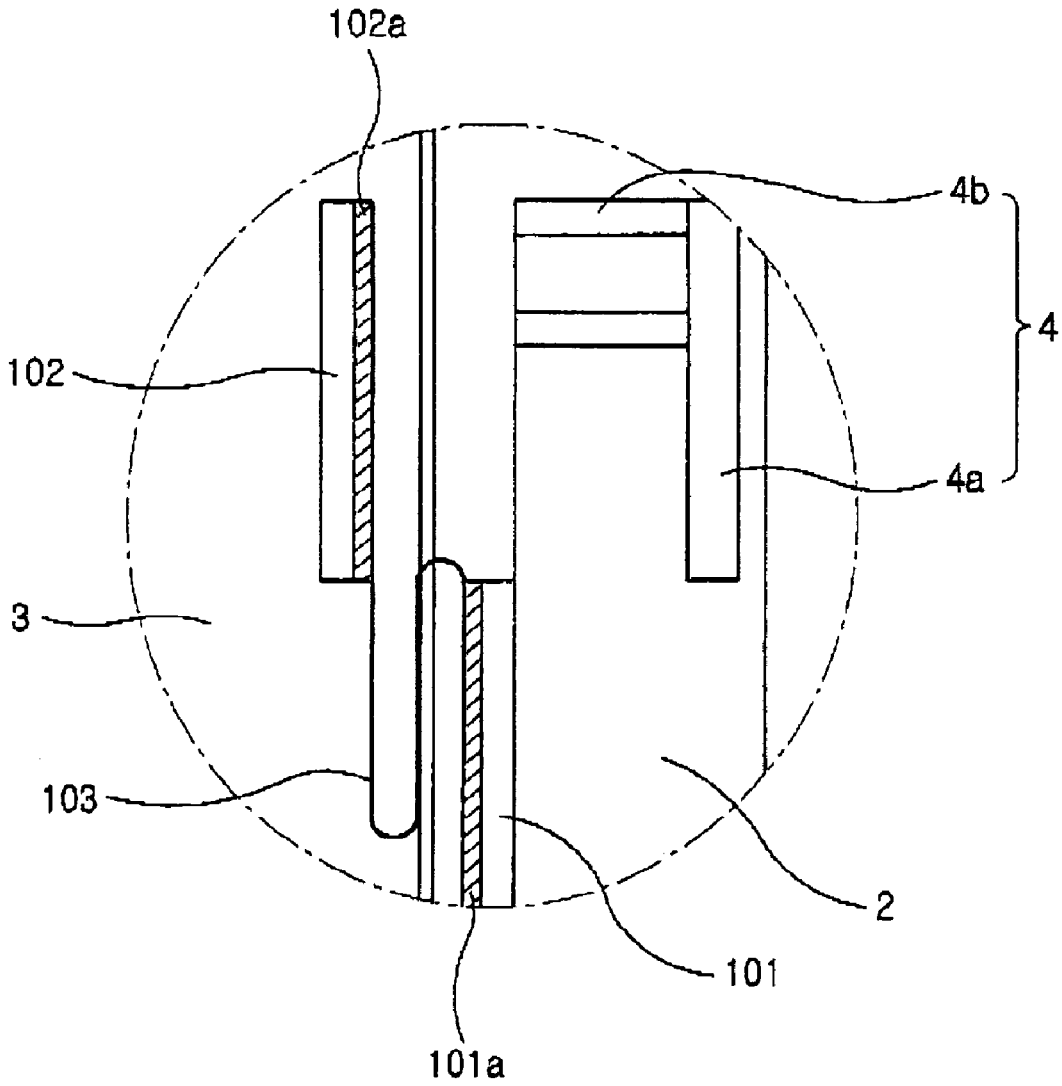
FIG. 6 is a enlarged side cross-sectional view showing an enlarged section A of FIG. 5.

As shown in FIGS. 5 and 6, an antenna apparatus of a portable terminal includes a variable movement antenna apparatus 100 variably moving a position of a second ground surface 102*a* by separating a first ground surface 101*a* and the second ground surface 102*a* and by slidably moving the second ground surface 102*a* in the lengthwise direction of a body housing 2 so that the second ground surface 102*a* becomes closer to and farther away from the first ground surface 101*a*. The variable movement antenna apparatus 100 is provided by the body housing 2 and the sliding housing 3.

Figure 7:
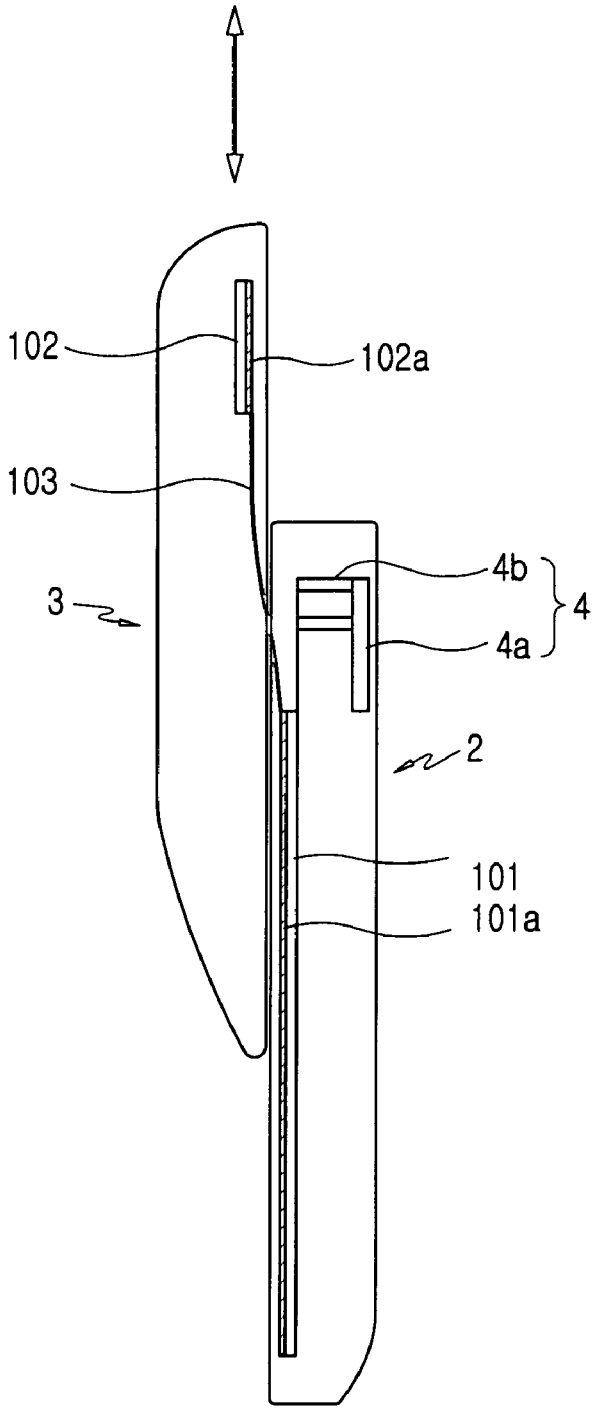
FIG. 7 is a side cross-sectional view showing an operational state of an antenna apparatus of a portable terminal according to a preferred embodiment of the present invention.

As shown in FIG. 7, the variable movement antenna apparatus 100 includes a fixed printed circuit board 101, a moving antenna board 102, and a connecting means 103. The fixed printed circuit board 101 is provided in the body housing 2 so as to be electrically connected to a built-in antenna 4 mounted into the body housing 2. The first ground surface 101*a* is provided in the fixed printed circuit board 101. The moving antenna board 102 is provided in the sliding housing 3 so that the position of the second ground surface 102*a* is variably moved when the sliding housing 3 is slidably moved so as to become closer to and more remote from the body housing 2. The second ground surface 102*a* is provided in the moving antenna board 102.

The connecting means 103 is mounted to the fixing printed circuit board 101 and the moving antenna board 102 so that the length thereof is varied, as the moving antenna board 102 is slidably moved, to transfer signals between the fixed printed circuit board 101 and the moving antenna board 102.

Further, as shown in FIGS. 6 and 7, the connecting means 103 includes a flexible circuit so that the length thereof is varied as the sliding housing 3 is slidably moved.

As shown in FIG. 7, the variable movement antenna apparatus 100 can be used as a monopole antenna if the moving antenna board 102 is slidably moved together with the sliding housing 3 so as to be remote from the body housing 2.

As shown in FIG. 5, the variable movement antenna apparatus 100 can be used as a planar inverted F and loop antenna 4 if the moving antenna board 102 is slidably moved together with the sliding housing 3 so as to be close to the body housing 2. In this case wherein the variable movement antenna apparatus 100 is used as the planar inverted F and loop antenna, the separated distance L2 between the radiation body 4*a* provided in the antenna 4 and the second ground surface 102*a* can be increased.

The moving antenna board 102 includes a ground surface of the planar inverted F and loop antenna 4.

Hereinafter, the operation of the antenna apparatus of the portable terminal according to the preferred embodiment of the present invention will be explained in detail with reference to FIGS. 5 and 7.

As shown in FIGS. 5 and 6, the body housing 2 of the terminal includes the fixed printed circuit board 101 in which the planar inverted F antenna 4 is mounted and the first ground surface 101*a* electrically connected to the antenna 4.

The sliding housing 3 includes the moving antenna board 102 in which the second ground surface 102*a* is variably moved as the sliding housing 3 is slidably moved.

As shown in FIG. 7, if the sliding housing 3 is slidably moved so as to be remote from the body housing 2, the movement antenna board 102 is also slidably moved together with the sliding housing 3.

Then, the second ground surface 102*a* of the moving antenna board 102 is slidably moved together with the moving antenna board 102, and the position of the second ground surface 102*a* is varied.

In the state, as shown in FIG. 7, the variable movement antenna apparatus 100 is used as a monopole antenna.

By slidably moving the sliding housing 3 and moving the second ground surface 102*a* of the moving antenna board 102, the planar inverted F antenna 4 is prevented from being screened by the sliding housing 3, thereby improving the gains and the efficiency of the antenna.

Now, as shown in FIG. 5, if the sliding housing 3 is slidably moved so as to be close to the body housing 2, the moving antenna board 102 is also slidably moved together with the sliding housing 3 and is used as the ground surface of the planar inverted F antenna 4.

In this state, the variable movement antenna apparatus 100 is used as the planar inverted F and loop antenna 4.

In the case where the variable movement antenna apparatus 100 is used as the planar inverted F and loop antenna 4, the separated distance L2 between the radiation body 4*a* provided in the antenna 4 and the second ground surface 102*a* increases, thereby improving the gains and the efficiency of the antenna.

As above-mentioned, as the variable movement antenna apparatus variably moves the position of the ground surface of the antenna, the performance of the antenna improves. Further, by increasing the separated distance between the radiation body of the built-in antenna and the ground surface, the gains and the efficiency of the antenna improve.

While the invention has been shown and described with reference to certain a preferred embodiment thereof, it will be understood by those skilled in the art that various changes in form and details may be made therein without departing from the spirit and scope of the invention as defined by the appended claims.

For example, the present invention can be applied to all kinds of portable terminals.

What is claimed is:

1. A sliding type portable terminal comprising:

a body housing;

a sliding housing slidably moved to and from the body housing;

a built-in antenna provided in the body housing; and a variable movement antenna apparatus, which comprises a first ground surface and a second ground surface movably and electrically connected to the first around surface so that the second ground surface is close to and, under an orthographic projection, separate from the first ground surface.

2. A sliding type portable terminal according to claim 1, wherein the variable movement antenna apparatus comprises:

a fixed printed circuit board mounted into the body housing and in which the first ground surface is provided and electrically connected to the built-in antenna, a moving antenna board mounted into the sliding housing and receiving the second ground surface; and a connecting means for electrically connecting the fixed printed circuit board and the moving antenna board in which the length of the connecting means is varied as the moving antenna board is slidably moved.

3. A sliding type portable terminal according to claim 2, wherein the connecting means includes a flexible circuit to vary the length thereof.

4. A sliding type portable terminal according to claim 2, wherein the moving antenna board provides a ground surface for a planar inverted F antenna.

5. A sliding type portable terminal according to claim 1, wherein the variable movement antenna apparatus constitutes a monopole antenna if the movement antenna apparatus is slidably moved together with the sliding housing so as to be remote from the body housing and constitutes a planar inverted F and loop antenna if the movement antenna apparatus is slidably moved together with the sliding housing so as to be close to the body housing.

6. A sliding type portable terminal according to claim 1, wherein in case the variable movement antenna apparatus is used as a planar inverted F and loop antenna, a separated distance is provided between a radiation body of the antenna and the second ground surface.

* * * * *